United States Patent [19]

McCrudden

[11] 4,128,495

[45] Dec. 5, 1978

[54] BLEACHING COMPOSITION

[75] Inventor: Joseph E. McCrudden, Warrington, England

[73] Assignee: Interox Chemicals Limited, London, England

[21] Appl. No.: 683,818

[22] Filed: May 6, 1976

[30] Foreign Application Priority Data

Nov. 18, 1975 [GB] United Kingdom ..... 47371/75

[51] Int. Cl.[2] ..... C11D 3/395; C11D 7/54; D06L 3/02

[52] U.S. Cl. ..... 252/186; 8/111; 252/95; 252/99; 260/502 R; 568/562

[58] Field of Search ..... 252/186; 225/95, 99; 260/502 R, 610 R, 610 A; 8/111.5

[56] References Cited

U.S. PATENT DOCUMENTS 2,287,064 6/1942 Reichert et al. ..... 252/186

2,453,071 11/1948 Hyatt et al. ..... 252/186

3,770,816 11/1973 Nielsen ..... 252/186

*Primary Examiner*—Benjamin R. Padgett

*Assistant Examiner*—Irwin Gluck

*Attorney, Agent, or Firm*—Larson, Taylor and Hinds

[57] ABSTRACT

The present invention provides bleaching or detergent compositions containing phthaloyl peroxide, preferably desensitized by intimate contact with a diluent e.g. magnesium sulphate, lauric acid or sodium trypolyphosphate, and coated to reduce destructive interaction with other components of the detergent or bleaching composition. Optionally the compositions can contain a persalt, e.g. sodium perborate, preferably in a ratio of one mole per mole of phthaloyl peroxide.

The compositions are particularly suitable for washing/bleaching fabric at a temperature of from 30° to 60° C.

17 Claims, No Drawings

BLEACHING COMPOSITION

The present invention relates to bleaching compositions, detergent compositions containing a bleaching agent or precursor and to processes for bleaching.

According to the present invention there are provided bleaching or detergent compositions containing phthaloyl peroxide optionally substituted by a lower alkyl, chloro or nitro radical.

According to a second aspect of the present invention there is provided a process for bleaching using an aqueous solution of a bleaching or detergent composition containing phthaloyl peroxide optionally substituted by lower alkyl, chloro or nitro radical.

Phthaloyl peroxide is a cyclic peroxide and as such it contains an —O—O— bond in a somewhat strained ring. In consequence, care must be taken in handling the product, and it is highly desirable that bleaching compositions contain only a minor proportion of phthaloyl peroxide. Preferably, when in solid compositions, the phthaloyl peroxide is in intimate contact with a desensitising amount of a desensitising diluent, i.e. an amount which reduces the impact sensitivity sufficiently to render the composition nonhazardous. In a standard drop weight test, 30 mg of material, which has been sieved to finer than 710 microns, is placed on an anvil in the apparatus. The anvil is centred and the sample tamped lightly by a force of 5 Kg-cm. A weight is then dropped several times from a given height, each time onto a fresh sample, and its effect observed. A positive result can range from being merely a discoloured product, through emission of a cloud of smoke, to, in an extreme case, an explosion. Tests are carried out at a series of heights. A higher proportion of positive results occur when a greater force is employed. The figure usually quoted is the median point, i.e. the point at which 50% of the results at a given force are positive. compositions having a median point of at least 200 Kg-cm are considered to be non-hazardous, but to provide a greater margin of safety compositions preferably have a median point of at least 300 Kg-cm.

Generally the desensitising amount is selected within the range of 1 to 10 parts by weight of diluent per part of bleaching agent. Suitably the desensitizing diluent can be selected from hydrocarbons having melting points in excess of 30° C, e.g. microcrystalline waxes, aliphatic fatty acids e.g. lauric and stearic acids, aromatic acids e.g. benzoic acid, alkyl, e.g. t-butyl, esters of the aliphatic or aromatic acids, protein or starch materials, boric acid and especially alkali and alkaline earth metal salts of halogen-free acids having a first dissociation constant of at least $1 \times 10^{-3}$, e.g. sodium sulphate, magnesium sulphate and sodium tripolyphosphate. The intimate contact can be by way of admixing particles of the diluent with the phthaloyl peroxide or by granulating or coating the phthaloyl peroxide with the diluent. More than one diluent may be employed, conveniently first contacting the phthaloyl peroxide with an unreactive diluent described hereinbefore, and then coating the mixture with a second diluent. Such second diluent can be selected from fatty acid alkanolamides, fatty alcohol polyglycol ethers, polyglycol and polypropylene oxide polymers, alkaryl polyglycol ethers, polyethylene glycol and fatty acid esters and, amides thereof, and esters and amides of glycerol and sorbitol, polyvinyl alcohol, polymethyl methacrylate, dextrin, starch, gelatin carboxymethyl methacrylate, solid hydrocarbons, aliphatic fatty acids, fatty alcohols, sodium sulphate and magnesium sulphate. "Fatty" in the terms "fatty alcohol" and "fatty acid" is used to denote at least 12, desirably from 12 to 26 carbon atoms in the longest chain. Normally the amount of coating is within the range of 3% to 35% by weight based on the weight of the coated product. Phthaloyl peroxide thus coated is less prone to decomposition when stored in contact with alkaline surfactants, such as sodium salts of alkyl benzene sulphonates, which are commonly employed in detergent and bleaching compositions.

When phthaloyl peroxide is dissolved in an aqueous medium it is hydrolysed to produce monoperoxyphthalic acid. However, in preferred embodiments the aqueous medium contains perhydroxyl anions, which can react with phthaloyl peroxide to form diperoxyphthalic acid. The diperoxyacid not only contains twice as much active oxygen, and thus makes more effective use of the phthaloyl peroxide, but also seems more effective than monoperoxy phthalic acid at removing stains from textile fabrics under household washing conditions at any given concentration of active oxygen. Although we do not wish to be bound by any theory, we believe that this phenomenom may be caused by electrostatic repulsion between the bleaching species and the negatively charged fabric surface. Carboxy groups have in general a much lower pKa than peroxycarboxy groups, and hence at any given pH a higher proportion of carboxy groups will be ionised than is the case for the corresponding peroxycarboxy groups. Thus, the tendency for the molecule to be negatively charged increases as the proportion of carboxy groups increases, and hence the degree of repulsion between bleaching species and fabric increases.

The perhydroxyl anions can be provided by separate addition of hydrogen peroxide or any inorganic active oxygen containing compounds hereinafter called persalts such as sodium perborate or sodium percarbonate (the hydrogen peroxide addition product). Preferably the composition for bleaching or the detergent composition contains the persalt in a mole ratio to the phthaloyl peroxide, of from 5:1 to 1:5 desirably a mole ratio of from 2:1 to 1:2, and particularly a mole ratio of approximately 1:1.

Generally bleaching solutions according to the present invention contain at least 1 ppm available oxygen "av. ox" and for use in washing textile fabrics, e.g. cotton or cotton/polyesters often from 5 to 200 ppm "av.ox". Solutions for cleaning surfaces such as metal, plastic or wooden surfaces often contain from 200 ppm to 500 ppm "av. ox". If desired, solutions produced by the dissolution of phthaloyl peroxide compositions described herein can be used to bleach textile fabrics, wood or pulp under the conditions, and employing the equipment used for bleaching such articles with hydrogen peroxide or inorganic peroxoacids.

Suitably bleaching/washing in the home can take place at ambient temperature or higher, conveniently in the range of 25° to 60° C. In general, the bleaching and detergent composition are each formulated to produce solutions having a pH of between 8.5 and 11.5; preferably from 8.5 to 9.5.

Detergent or bleaching compositions containing phthaloyl peroxide also contain a surfactant and a builder salt, often contain a processing additive and detergent adjuncts such as organic sequestrants e.g. EDTA, peroxyacid stabiliser e.g. brightening agents and inorganic active oxygen-containing compounds, hereinafter called persalts, which generate perhydroxyl ions in aqueous solution, such as sodium perborate tetrahydrate or sodium percarbonate (the commercially available hydrogen peroxide addition product).

Suitable builder salts can be either organic, for example aminopolycarboxylates, organic polyphosphates, sodium citrate or sodium gluconate, or inorganic, for example, alkali metal carbonates, silicates, phosphates, polyphosphates or aluminosilicates. Typically, builders are present in proportions of from 1% to 90% by weight. Such compounds alter the pH detergent/-bleaching solutions. Preferably sufficient builder salt is used to adjust the pH of the solution to from pH 7 to 11, more preferably down pH 8 to 11.

A typical processing aid is sodium or magnesium sulphate which is conveniently incorporated in detergent/bleaching compositions in an amount of from 1 to 40% by weight.

Where some builder salt or processing aid has been used to desensitise phthaloyl peroxide the amount so used is included in the total amount of builder salt or processsing aid present in the composition.

The surfactants may conventionally be water-soluble anionic, non-ionic, ampholytic or zwitterionic surface active agents. Suitable surfactants are often selected from fatty acids and their alkali metal salts, alkyl sulphonates, alkylated aryl sulphonates, especially lineur alkyl benzene sulphonates, sulphated aliphatic olefins, sulphated condensation produces of aliphatic amides and quaternary ammonium compounds. The surfactants are normally present in the detergent composition in amounts of from 1% to 90% by weight, often in a weight ratio to the builder salts of from 2:1 to 1:10.

The bleaching composition can include any compound or compounds which enhance the bleaching or washing activity of organic peroxyacids, such as ketones and aldehydes as described in U.S. Pat. No. 3822114 or certain quaternary ammonium salts as described in British Pat. No. 1376671, both to Proctor & Gamble.

One convenient method of providing a diluent/phthaloyl peroxide suitable for incorporation in a detergent composition and substantially isolated from alkaline surfactants is to form a mixture of particulate phthaloyl peroxide with a particulate inorganic diluent such as sodium sulphate or tripolyphosphate or magnesium sulphate into tablets or extrudate. Such tablets or extrudates by themselves effectively reduce the surface of phthaloyl peroxide presented to the alkaline surfactants, and thus alleviate the problem of loss of active oxygen during storage. The problem can be further alleviated by providing an outer layer around the tablets or extrudates comprising at least one of the coating compounds described hereinbefore, generally in an amount of up to 20% by weight. Alternatively any suitable organic compound described hereinbefore may be formed into a flexible sachet within which a duluent/phthaloyl peroxide mixture can be placed. Advantageously the tablet or extrudate, or sachet can contain the persalt in a mole ratio of phthaloyl peroxide to persalt of from 2:1 to 1:2, and preferably approximately 1:1.

Phthaloyl peroxide can be obtained by reacting phthaloyl chloride with excess concentrated hydrogen peroxide, in an alkaline ethereal solution, at a temperature of about 0° C. Preferably a desensitising diluent, such as magnesium sulphate is thoroughly mixed with the phthaloyl peroxide before it is separated from its mother liquor.

Specific embodiments of the present invention will now be described more fully by way of example.

The effectiveness of bleaching compositions according to the present invention is compared with conventional inorganic persalts in washing stained fabrics with 1 litre water containing 4 gms of a detergent composition comprising linear alkyl benzene sulphonate 15%, sodium tripolyphosphate 37%, sodium silicate 6%, coconut monoethanolamide 3%, sodium carboxy methylcellulose 1.5%, water 6% and balance sodium sulphate, the %s being by weight, and sufficient active oxygen containing compounds to yield 10 ppm active oxygen in solution.

The washing is carried out at a temperature in the range of 30° to 60° C and at a pH of 9. The oxygen containing compounds consist of (a) sodium perborate tetrahydrate, (included for comparison) (b) phthaloyl peroxide and (c) a mixture of (a) and (b) each providing 5 ppm of active oxygen. The fabrics comprise cotton or polyester cotton mixtures, and the stains are conventional household stains. The stain removal is measured and broadly it is found that the order of stain removal is (c) > (b) > (a) in the temperature range of 30° to 60° C.

I claim:

1. A solid bleaching or detergent composition comprising a surfactant, a builder salt and a bleaching agent, said bleaching agent comprising phthaloyl peroxide.

2. A solid bleaching or detergent composition according to claim 1 wherein said phthaloyl peroxide bleaching agent is in intimate contact with a desensitizing amount of a desensitizing diluent.

3. A solid bleaching or detergent composition according to claim 2 wherein said phthaloyl peroxide is granulated with said desensitizing diluent.

4. A solid bleaching or detergent composition according to claim 3 wherein said surfactant comprises an alkaline surfactant and wherein the granulated product bears a coating of from 3 to 35% by weight of a coating agent to render the phthaloyl peroxide less prone to decomposition when stored in contact with said alkaline surfactant.

5. A solid bleaching or detergent composition according to claim 1 further comprising a persalt in a mole ratio to said phthaloyl peroxide of from 1:5 to 5:1.

6. A solid bleaching or detergent composition according to claim 5 wherein said mole ratio is from 2:1 to 1:2.

7. A solid bleaching or detergent composition according to claim 5 wherein said mole ratio is approximately 1:1.

8. A solid bleaching or detergent composition according to claim 1 wherein said phthaloyl peroxide is substituted by a member of the group consisting of lower alkyl, chloro, or nitro.

9. A solid bleaching or detergent composition according to claim 1 further comprising at least one detergent adjunct selected from the group consisting of colors, perfumes, bleach stabilizers, optical brightening agents, soil antiredeposition agents, enzymes, dedusting agents, tarnish inhibitors, and abrasives.

10. A solid bleaching or detergent composition according to claim 1 further comprising at least one member selected from the group consisting of sodium sulfate and magnesium sulfate in an amount of from 1 to 40% by weight.

11. A solid bleaching or detergent composition according to claim 2 wherein said surfactant is alkaline and wherein said phthaloyl peroxide is present in said composition in intimate contact with said desensitizing diluent in the form of a plurality of discrete bodies, said discrete bodies bearing a coating of from 3 to 35% by weight of a coating agent to render the phthaloyl peroxide less prone to decomposition when stored in contact with said alkaline surfactant.

12. A process for bleaching which comprises contacting a material to be bleached with an aqueous bleaching composition containing phthaloyl peroxide and a persalt whereby diperoxyphthalic acid is generated in solution.

13. A process according to claim 12 wherein said phthaloyl peroxide is substituted with a member of the group consisting of lower alkyl, chloro and nitro.

14. A process according to claim 12 wherein said material comprises textile fabric and wherein the aqueous solution contains 5 to 200 ppm available oxygen.

15. A process according to claim 12 wherein the aqueous solution is maintained at a temperature of from 25° C to 60° C.

16. A process according to claim 12 wherein the aqueous solution is maintained at a pH of from 8.5 to 11.5.

17. A process according to claim 12 for treating a hard surface wherein the aqueous solution contains from 200 to 500 ppm available oxygen.

* * * * *